United States Patent [19]

Rowley

[11] 4,086,263

[45] Apr. 25, 1978

[54] SHIPPING RACK HAVING SPACER STRIPS ATTACHED THERETO

[75] Inventor: James R. Rowley, Freeport, Pa.

[73] Assignee: PPG Industries, Inc., Pittsburgh, Pa.

[21] Appl. No.: 742,381

[22] Filed: Nov. 17, 1976

[51] Int. Cl.[2] ..... B65D 85/48

[52] U.S. Cl. ..... 206/454; 105/376; 206/593; 211/40; 214/10.5 R

[58] Field of Search ..... 206/586, 593, 309, 310, 206/448, 449, 451, 453, 454; 214/10.5 R; 312/14, 321, 325; 211/40; 105/376, 392.5

[56] References Cited

U.S. PATENT DOCUMENTS

| | | | |
|---|---|---|---|
| 2,143,638 | 1/1939 | Weidman | 206/454 |
| 2,720,204 | 10/1955 | Wallach | 206/309 |
| 3,147,860 | 9/1964 | Kean, Sr. et al. | 206/448 |
| 3,207,318 | 9/1965 | Gilbert | 206/309 |
| 3,216,564 | 11/1965 | Wolfe, Jr. et al. | 206/448 |
| 3,391,792 | 7/1968 | Makar | 211/40 |
| 3,489,475 | 1/1970 | Boyce et al. | 312/14 |
| 3,838,777 | 10/1974 | Thornicroft et al. | 211/41 |
| 3,995,738 | 12/1976 | Rowley et al. | 206/451 |

FOREIGN PATENT DOCUMENTS

| | | | |
|---|---|---|---|
| 14,624 of | 1929 | Australia | 312/14 |
| 2,234,949 | 1/1974 | Germany | 206/454 |

*Primary Examiner*—William Price
*Assistant Examiner*—Bruce H. Bernstein
*Attorney, Agent, or Firm*—Donald Carl Lepiane

[57] ABSTRACT

A shipping rack of the type having a backwall secured to a base for supporting automotive windshields in a vertical position has spacer strips pivotally mounted on each of a pair of spaced bars secured to the rack. A spacer strip from each of the bars is positioned between adjacent windshields to separate the windshields loaded on the rack. Restraining facilities secure the windshields on the rack.

16 Claims, 6 Drawing Figures

FIG. 6
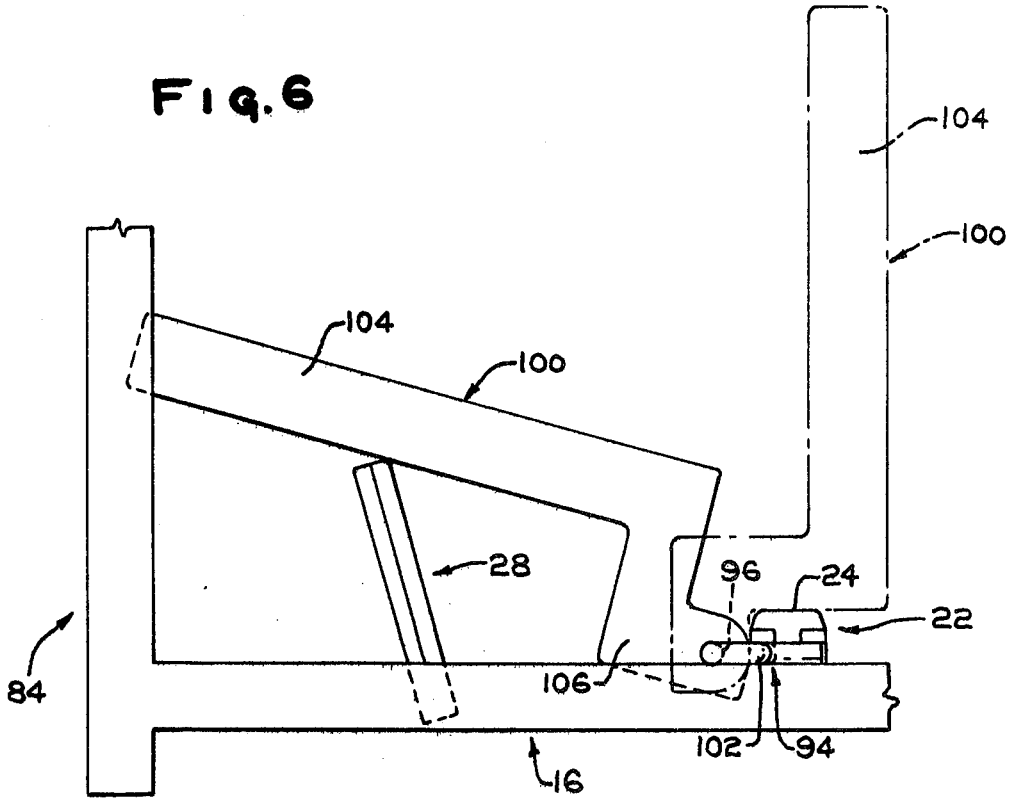
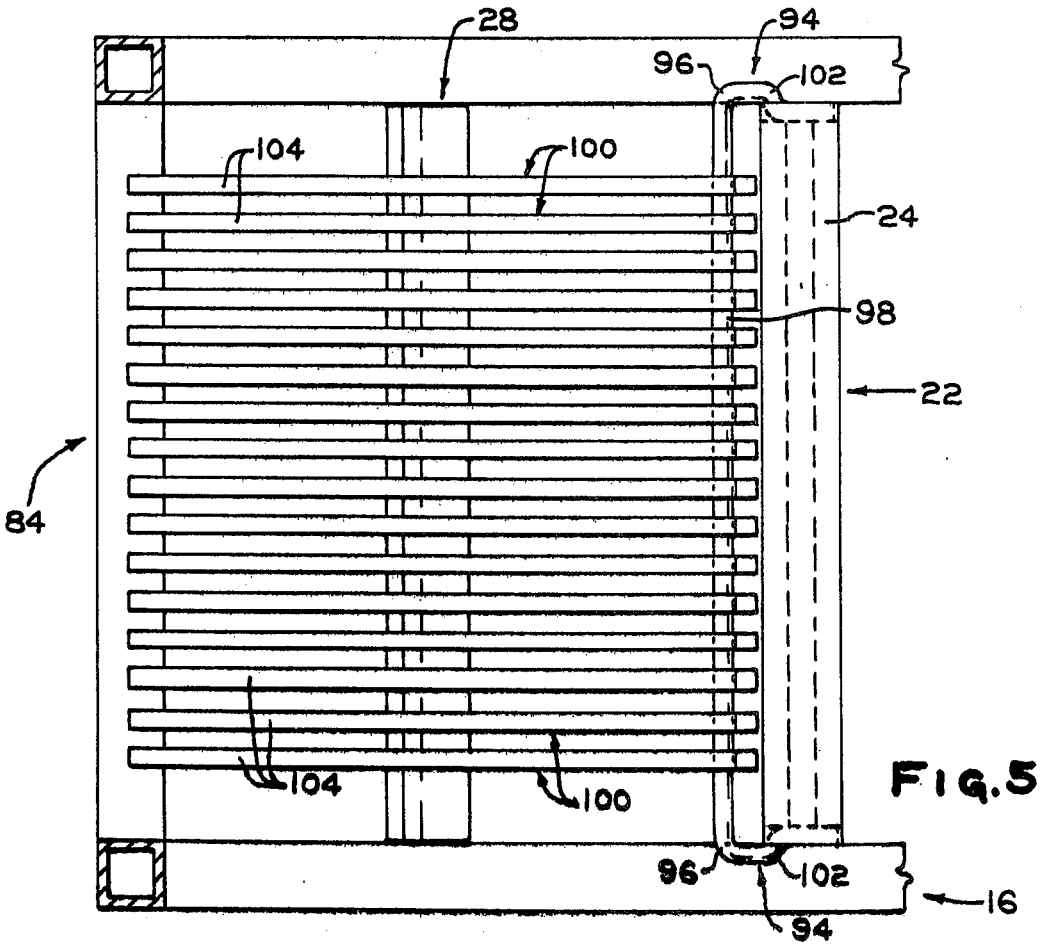
FIG. 5

SHIPPING RACK HAVING SPACER STRIPS ATTACHED THERETO

BACKGROUND OF THE INVENTION

1. Field of the Invention

This invention relates to a sheet shipping rack having spacer strips secured thereto. The spacer strips separate the sheets, for example, glass sheets or automotive windshields to prevent surface contact between adjacent sheets and absorb transportation forces.

2. Discussion of the Prior Art

Glass articles, for example, glass sheets, automotive backlites or automotive windshieds are normally shipped to automotive manufacturers in bins or racks. To prevent damage to the glass articles during shipment, several expediencies are employed.

The windshields are normally loaded on the rack in a generally vertical position with an edge of the windshields resting on a resilient pad and the windshields tilted toward and resting against back support members. Corrugated fiberboard spacers are inserted between each windshield to prevent surface contact between adjacent windshields and absorb transportation forces. A restraint system urges the windshields toward each other about the spacers and the back support members.

A rack of the type discussed above is taught in U.S. Published Patent Application No. B371,912 published Mar. 2, 1976 based on U.S. Patent Application Ser. No. 371,912 now U.S. Pat. No. 3,995,738 filed on June 20, 1973 in the names of James R. Rowley and Walter E. Pater and entitled "Shipping Bin for Sheets with Device for Restraining Movement of the Sheets".

After the rack is unloaded, disposing of the corrugated fiberboard spacers is a solid waste problem. Further, discarding the spacers increases the shipping costs because the spacers are not reused.

It would be advantageous therefore if a rack was available that did not have the limitations of the prior art mentioned above.

SUMMARY OF THE INVENTION

This invention relates to an improved rack for shipping sheets e.g., automotive windshields. The rack is of the type having a backwall secured to the base for shipping the sheets on an edge in a generally vertical position. The improvement includes a plurality of separators or spacer strips for insertion between the sheets to be shipped and facilities for securing the separators to the rack.

BRIEF DESCRIPTION OF THE DRAWING

FIG. 5 is a view taken along lines 5—5 of FIG. 3 showing spacer strips in the unloaded or preload position; and FIG. 6 is an enlarged view of left side of the rack shown in FIG. 3 having portions removed for purposes of clarity.

DESCRIPTION OF THE INVENTION

In the following discussion, like numerals refer to like elements.

Figure 1:
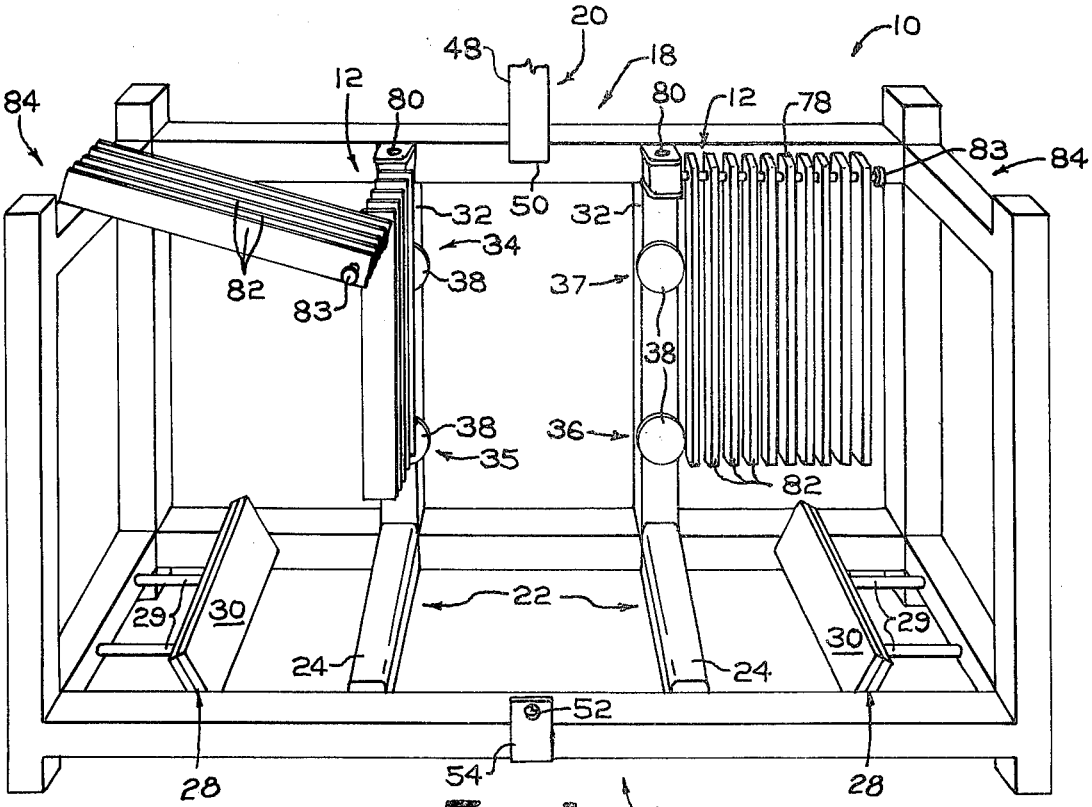
FIG. 1 is a front view of an article shipping rack incorporating features of the invention and having portions removed for purposes of clarity.
Figure 2:
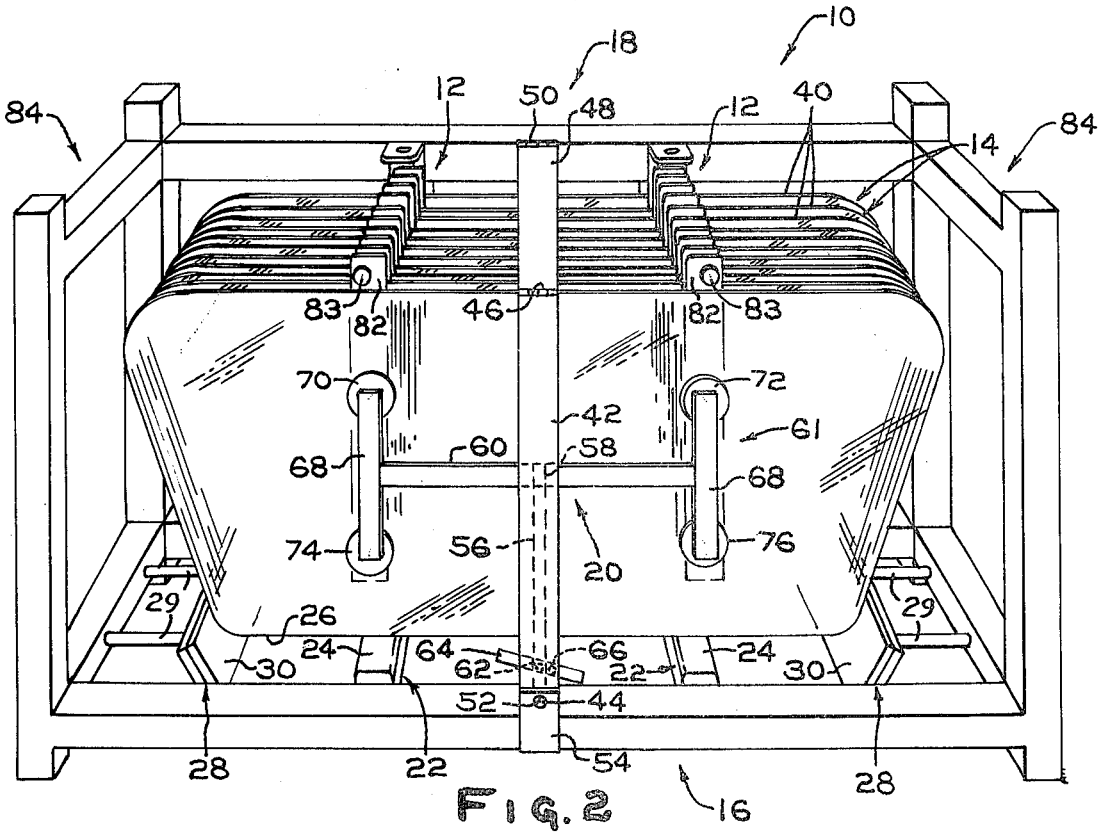
FIG. 2 is the rack shown in FIG. 1 loaded with articles.

Referring to FIGS. 1 and 2, there is shown an article shipping rack 10 having a pair of spacer strip assemblies 12 incorporating features of the invention attached thereto for separating articles 14 shown in FIG. 2. The articles 14 that may be shipped in the rack 10 are not limiting to the invention and may include glass sheets, automotive windshields, automotive sidelites and automotive backlites.

As will be apparent, the invention is not limited to the type of rack and any of the types of racks known in the art may be used in the practice of the invention. In general, the rack shown in FIGS. 1 and 2 is of the type taught in U.S. Published Patent Application No. B371,912 published Mar. 2, 1976 based on U.S. Patent Application Ser. No. 371,912 now U.S. Pat. No. 3,995,738 filed June 20, 1973 in the names of James R. Rowley and Walter E. Pater and entitled "Shipping Bin for Sheets with Device for Restraining Movement of the Sheets". The teachings of the above-identified U.S. Published Patent Application are hereby incorporated by reference.

The rack 10 includes a base 16, a backwall 18 and a restraining device 20 mounted at the ingress end or front of the rack 10 as shown in FIG. 2.

The base 16 includes a pair of stationary runners 22 each having resilient pads 24 for supporting the articles 14 on an edge 26 as shown in FIG. 2. Movable end restraints 28 are mounted on guiderails 29 and have a resilient pad 30 engaging the articles 14 as shown in FIG. 2. The end restraints 28 are locked in position in any conventional manner to prevent longitudinal movement of the articles during transit.

The backwall 18 includes a pair of stationary vertical cross members 32 on which are mounted back support members 34, 35, 36 and 37 in any conventional manner.

Each of the back support members 34–37 are provided with a resilient pad 38 to (1) prevent surface marring of the articles 14 and (2) minimize pressure points acting on the articles 14. The back support members 35 and 36 are spaced a greater distance from their respective cross member 32 than the support members 34 and 37 to tilt the articles 14 for packing stability.

The back support members 34 and 37 are preferably adjustable at a selected spaced distance from top edge 40 of the articles as viewed in FIG. 2. In this manner, pressure brought to the articles 14 is not directly at the top edge 40 thereby reducing to a minimum the possibility of damage. Because the articles 14 are resting on the bottom edge 26, the bottom back support members 35 and 36 are normally maintained in a fixed position relative to the base 16.

With specific reference to FIG. 2, the restraining device 20 includes a hollow, rigid member 42 having a stud 44 mounted at the bottom thereof and the top of the rigid member 42 pivoted at 46 to span member 48. The opposite end of the span member 48 is pivoted at 50 to the top of the backwall 18 so that the restraining device 20 may be moved away from the front end of the rack during loading or unloading of the articles 14.

The restraining device 20 is mounted at the ingress or front end of the rack by sliding the stud 44 into hole 52 of a retaining plate 54 mounted to the base 16. In this manner, the restraining device 20 is held in position during transit of the articles and may be easily removed to load or unload the articles from the rack.

A rigid bar 56 is mounted in the rigid member 42 and operatively connected at 58 to elongated member 60 of generally H-shaped member 61. The other end of the bar 56 is pivotally connected at 62 to a lever 64. The lever 64 passes through the hollow member 42 and is pivotally connected at 66 to the hollow member 42 as shown in FIG. 2. Rotating the lever 64 in a first direction displaces the H-shaped member 61 toward the backwall 18 to urge the articles toward the backwall 18. Rotating the lever 64 in a second opposite direction displaces the H-shaped member 61 away from the backwall 18.

Outer legs 68 of the H-shaped member 61 are pivotally mounted at the ends of the elongated member 60 in any conventional manner. Each of the outer legs 68 are provided at one end with top pressure pads 70 and 72 and at the opposite end with bottom pressure pads 74 and 76. Each of the pressure pads includes a layer of resilient material (not shown) to prevent marring of and minimize pressure points on the articles 14.

The bottom pressure pads 74 and 76 are preferably in spaced alignment with back support members 35 and 36, respectively, and the top pressure pads 70 and 72 are preferably in spaced alignment with back support members 34 and 37, respectively.

The preceeding is a general discussion of a rack similar to the type taught in U.S. Published Patent Application B371,912 that may be used in the practice of the invention. A more detailed description may be had from the teachings of U.S. Published Patent application No. B371,912 now U.S. Pat. No. 3,995,738.

The discussion will now be directed to the spacer strip assemblies 12 incorporating features of the invention. As shown in FIGS. 1 and 2, there are two proper strip assemblies 12. However as will be appreciated, the invention is not limited thereto. For example one spacer strip assembly may be used with the rack of the type taught in U.S. Pat. No. 3,964,608 which teachings are hereby incorporated by reference. Further, 3, 4 or more spacer strip assemblies of the invention may be used on a shipping rack.

Each of the spacer strip assemblies 12 includes a bar 78 (clearly shown at right side of rack in FIG. 1). The bars 78 are preferably pivoted at 80 to the backwall 18 for return shipment or when the rack is nestable. A type of nestable rack that may be used in the practice of the invention is taught in U.S. Patent Application Ser. No. 618,609 now U.S. Pat. No. 4,010,849 filed on Oct. 1, 1975 in the names of Walter E. Pater and James R. Rowley for a "Nestable Shipping Rack Having Pitovally Mounted End Restraints".

The teachings of U.S. Patent application Ser. No. 618,609 are hereby incorporated by reference.

Mounted on each of the bars 78 are a plurality of spacer strips 82. The spacer strips are captured on their respective bar 78 in any conventional manner e.g., by a cap 83 threaded on the end of the bar 78. The spacer strips 82 are preferably made of a resilient compressible material to absorb transportation shocks. Types of material used in the practice of the invention, but not limited thereto, are rubber, plastic, corrugated fiberboard, felt or a composite, e.g., metal and rubber.

The width of the strips 82 is not limiting to the invention. However, it is recommended that the width be at least equal to or greater than the diameter of back support members 34–37 and the diameter of the pads 70, 72, 74 and 76. In this manner, the bending forces applied about the spacer strips by the pads of the H-shaped member 61 are minimized. The thickness of the spacers is not limiting to the invention but should be of sufficient thickness to separate the articles.

In the practice of the invention, it is preferred that the bars 78 be aligned with its respective ones of the back support members 34–37. With this arrangement, the spacers 82 in the vertical or load position lie between the pads of the H-shaped member and corresponding back support members. Therefore, the forces applied to the articles by the H-shaped member 61 will not cause bending moments to act on the articles 14.

The length of the spacer strips 82 is not limiting to the invention. However, it is recommended that they extend at least below the bottom pads 74 and 76 of the H-shaped member. Preferably the strips 82 are of a length sufficient to position them on adjacent sidewalls 84, i.e., in the preload or unload positions as shown in FIG. 1 for ease of loading or unloading the rack in a manner to be discussed below. The length of the bars 78 is selected to span the base 16 when the bar is positioned normal to the backwall 18, i.e., the load, preload or unload position.

In general, the rack 10 is loaded by pivoting the spacer strips 82 about their respective bar 78 to position the strips 82 on adjacent sidewall 84 as shown in FIG. 1. A first article is mounted in the rack resting on the back support members 34–37. A spacer strip 82 from each of the bars 78 is dropped to hang down toward the base. The next article is positioned against the hanging spacer strips and the next one of the spacer strip from each bar is dropped. The above is repeated until the rack is loaded.

The restraining device 20 is secured in position and the articles compressed by the H-shaped member 61 to urge the articles toward each other against the spacer strips and against the back support members 34–37.

Figure 3:
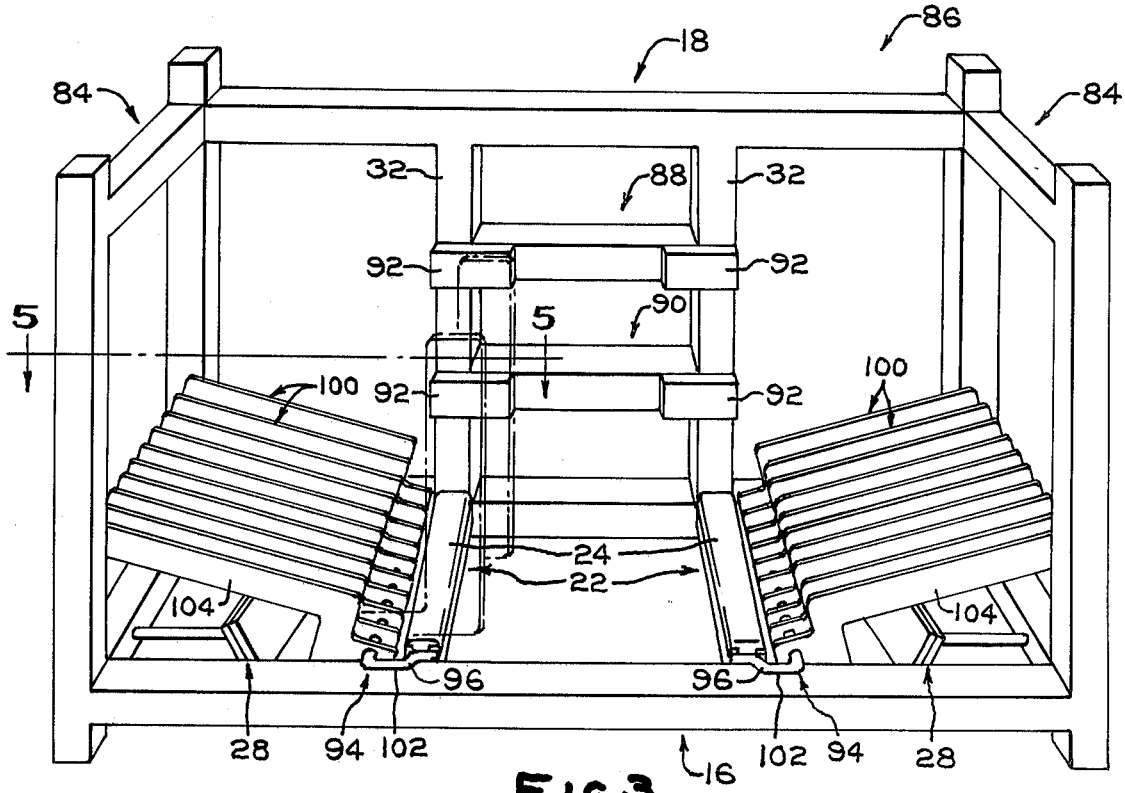
FIG. 3 is a front view of an article shipping rack incorporating an alternate embodiment of the invention.
Figure 4:
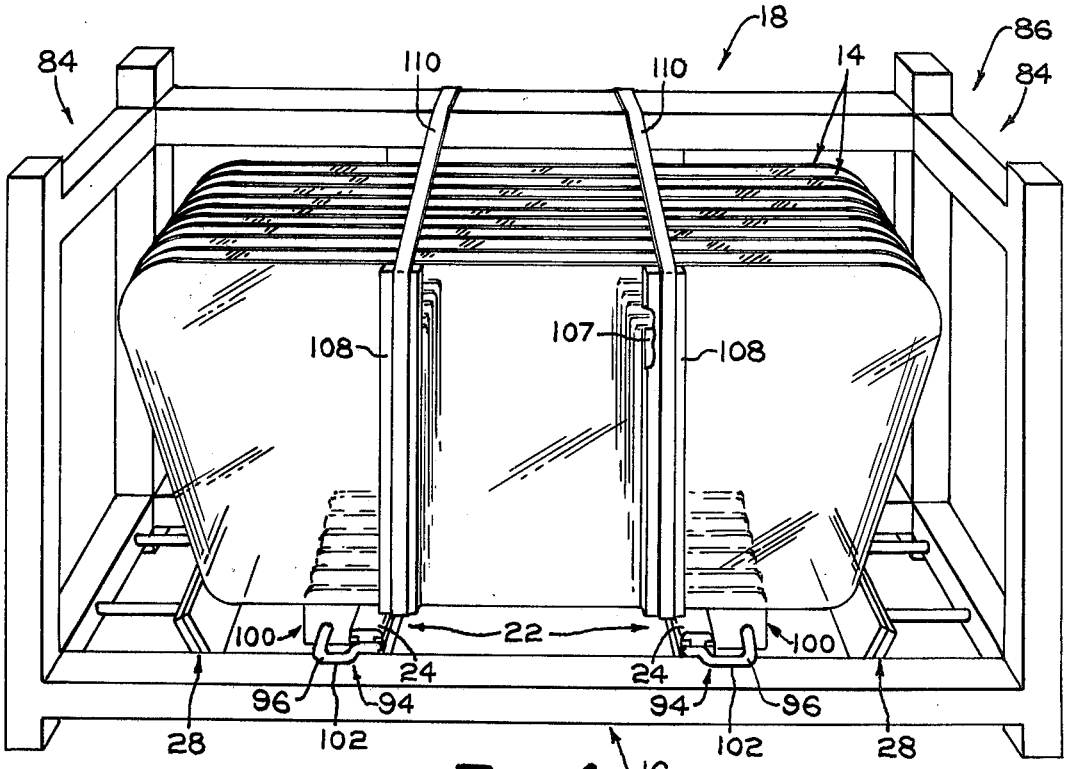
FIG. 4 is the rack shown in FIG. 3 loaded with articles.

With reference to FIGS. 3 and 4, there is shown an alternate embodiment of the invention. Rack 86 shown in FIGS. 3 and 4 is similar to the rack 10 shown in FIGS. 1 and 2 with the differences discussed below.

In place of the back support members 34–37 of the rack 10 shown in FIG. 1, the rack 86 has a pair of elongated bars 88 and 90. The elongated bars 88 and 90 are attached at opposite ends to the vertical cross members 32. The upper bar 88 is adjustable in any conventional manner for the same reasons discussed for the back support members 34 and 37 of rack 10.

A pair of spaced rubber pads 92 are mounted on each of the elongated bars 88 and 90 to prevent marring of the glass surface and to minimize pressure points.

The rack 86 has a pair of spacer strip assemblies 94 mounted on the stationary runners 22 of the base 16. With specific reference to FIG. 5, the spacer strip assemblies 94 each include a bar 96 having a central portion 98 for supporting spacer strips 100. The bar 96 includes ends 102 generally normal to the central portion and having a generally S-shaped configuration.

The ends 102 of the bar 96 are captured in opposed ends of the C-shaped channel of the stationary runners 22. As shown in FIGS. 3–6, the bars 96 are mounted on its respective stationary runner 22 on the side of the stationary runner facing a sidewall 84. As can be appreciated, the invention is not limited thereto and may be mounted on the opposite side of the stationary runner.

With specific reference to FIG. 6, the spacers 100 each have body portion 104 which is positioned between the articles and a dog leg end portion 106 that is mounted on the bar 96 and rests on the stationary runner when the spacer is in the vertical position, i.e., the load position.

The width of the body portion 104 of the spacers is preferably equal to or greater than the width of the padding 107 on lash boards 108 of the type used in the art and shown in FIG. 4. In this manner, pressure points on the articles are minimized or eliminated. In the load position, the body portion 104 of the spacer is aligned with respective ones of the pads 92. The upper end of the body portion 104 as shown in FIG. 5 is aligned with or extends beyond the padding 107 of the lash boards 108.

Referring now specifically to FIG. 4, the articles 14 are held in position by banding 110 of the type used in the art. The banding 110 has its course over the top of the articles 14 around the outside of the backwall 18, under the articles 14 and over the lash boards 108.

The configuration of the spacer strips 94 permit them to be mounted on the base as shown in FIG. 6 and be aligned with the lash boards 108 (see FIG. 4) and the rubber pads 92 (see FIG. 3).

As can now be appreciated, variations in the invention may be had without deviating from the scope of the invention.

DETAILED DESCRIPTION OF THE INVENTION

Fifty curved windshields 14 having a height of about 28 inches (71.12 centimeters) are loaded on rack 10 having a pair of spacer strip assemblies 12. In general the rack 10 is of the type taught in U.S. Published Patent Application No. B371,912 now U.S. Pat. No. 3,995,738.

With reference to FIG. 1, the rack 10 has a base 16, about 6 feet (1.8 meters) in length, and about 3 feet (0.9 meter) in depth; a backwall 18, about 6 feet (1.8 meters) in length and about 3⅔ feet (1.1 meter) high; and sidewalls 84 about 3⅔ feet (1.1 meter) high and about 3 feet (0.9 meter) wide.

In the following discussion, distances between elements are on a center-to-center distance unless indicated otherwise.

Back support members 34, 35, 36 and 37 are vertically aligned on respective ones of cross member 32 of the backwall 18. The back support members 35 and 36 are spaced about 4 inches (10.16 centimeters) from the base 16 and the back support members 34 and 37 are spaced about 26 inches (0.61 meter) from the base 16. The back support members 34–37 are each spaced about 25 inches (0.61 meter) from their adjacent sidewall 84. Each of the back support members 34–37 have a rubber pad 38 having a diameter of about 4 inches (10.16 centimeters).

A pair of about ⅜ inch (0.95 centimeter) diameter bars 78, each about 31 inches (0.78 meter) in length are pivotally mounted at 80 to the backwall 18. A one of the bars 78 is vertically aligned with the back support members 34 and 35 and the other bar 78 is vertically aligned with back support members 36 and 38.

The bars 78 are spaced about 6 inches (0.15 meter) above adjacent one of its respective one of the back support members 34 or 37.

Mounted on each rod are 49 spacers 82 each made of polyethylene having a width of about 4 inches (10.16 centimeters); a length of about 30 inches (0.75 meter); and a thickness of about 0.200 inch (5.08 centimeters). The spacers 82 each have a hole (not shown) having a dimaeter of about 13/32 inch (1.03 centimeters) for mounting the spacer on the bars 78 and captured thereon by cap 83.

The bars are set in the load position and the spacers 82 rotated to rest on the adjacent sidewall 84 (see FIG. 1).

Edge 26 of a windshield 14 is mounted on resilient pads 24 of stationary runners 22 resting against the back support members 34–37. A one of the spacers 82 from each of the bars 78 is dropped in front of the loaded windshield. The next windshield is positioned in a similar manner and the next ones of the spacers are dropped in front of the loaded windshield. The above is repeated until the rack is loaded.

After the rack is loaded, restraining device 20 of the type taught in U.S. Published Patent application No. B371,912 now U.S. Pat. No. 3,995,738 is positioned at the ingress end of the rack.

With reference to FIG. 2, pads 70, 72, 74, and 76 of H-shaped member 61 each have a diameter of about 4 inches (10.12 centimeters). At the ingress end of the bin, the pads 70, 72, 74 and 76 of the H-shaped member are aligned with back support members 34–37, respectively.

After the restraint device 20 is positioned at the ingress end of the rack 10, the H-shaped member 61 is urged against the automotive windshields 14 by rotating lever 64 as taught in the above-mentioned U.S. Published Patent Application. The restraining device urges the windshields against the spacers and the backwall.

At the point of destination, the restraining device 20 is removed and pivoted to rest on the backwall 18.

The outermost windshield is removed and the spacer strips 82 exposed are pivoted about their respective bar 78 to rest on the adjacent sidewall 84. The remaining windshields are removed in a similar manner. After the rack is unloaded, the spacer strips 82 are dropped down from the sidewalls of the rack. The bars 78 are pivoted against the backwall as shown at the right side of the rack 10 shown in FIG. 1 and the spacer strips 82 are bound together about adjacent cross member 32 in any conventional manner.

The discussion will now be directed to loading the windshields 14 on rack 86 shown in FIGS. 3 and 4. The rack 86 includes the base 16, sidewalls 84 and backwall 18 as previously discussed.

The backwall 18 of the rack 86 includes a pair of elongated bars 88 and 90 mounted between the vertical struts 32. Mounted on each bar 88 and 90 are a pair of rubber pads 92, each about 6 inches (1.27 centimeters) in length and spaced 28 inches (71.12 centimeters) apart. The spacing between the pads 92 and the base 16 and between the pads 92 and adjacent sidewalls 84 is generally the same as discussed for back support members 34–37. The pads 92 are spaced relative to the backwall 18 to provide a tilt to the windshields.

With reference to FIGS. 5 and 6, mounted on ends of each of the stationary runners 24 is a bar 96 each having 49 spacers 100 made of polyethylene pivotally mounted thereon.

The bar 96 is made of a ⅜ inch (0.95 centimeter) diameter rod having a central portion 104 about 3 feet (0.9 meter) long and S-shaped ends 102. The spacers 100 are mounted on the central portion 104 of the bars 96 and the ends 102 captured in ends of C-shaped member of the stationary runners 22 as shown in FIGS. 5 and 6.

The spacers 100 mounted on the support have a thickness of about 0.200 inch (0.508 centimeter) with a body portion 104 about 26 inches (0.61 meter) long and about 4 inches (10.16 centimeters) wide. The body portion 104 is connected to a dog leg end 106. The dog leg end 106 has a hole (not shown) having a diameter of about 13/32 inch (1.03 centimeter). The dog leg is sized such that the body portion 104 of the spacers 100 in the vertical position as shown in FIGS. 3 and 6 are aligned with respective ones of the pads 92 and extend about 2 inches (5.08 centimeters) beyond its respective runner as shown in FIG. 6.

The spacers 100 are positioned on adjacent end restraint 28. A windshield 14 is mounted on the base 18 as previously discussed and a spacer 100 is positioned in the vertical or load position as shown in FIGS. 3 and 5. The next windshield is positioned on the base and separated from the previously load windshield by the upright spacers. The next ones of the spacers are moved to the load position. The above is repeated until the rack is loaded.

Banding 110 about ⅝ inch (1.6 centimeter) wide and lash boards 108 secure the windshields on the rack 86 in any conventional manner. The lash boards have a width of about 3½ inches (8.9 centimeters) and a fiberboard pad 107 engaging the outermost windshield. The body portion 104 of the spacers 100 lie between the rubber pads 92 and lash boards 108.

The windshields 14 are removed in the reverse order of loading.

As can be appreciated, the examples were presented for illustration purposes only and are not limiting to the invention.

What is claimed is:

1. In a rack for shipping sheets wherein the rack is of the type having a backwall secured to a base and a pair of runners mounted on the base for shipping the sheets in a generally vertical position with the edge portions of the sheets supported on the runners, the improvement comprising:

a plurality of elongated discrete spacer strips each having a first end and a second end, wherein the first end of each of said spacer strips is to be inserted between adjacent ones of the sheets to be shipped and extends substantially beyond the top edge of each sheet such that adjacent sheets are maintained in spaced relationships to one another;

a rigid rod;

means for mounting said rod on the backwall of the rack; with said rod extending over and spaced from the base of the rack a distance greater than the height of the sheets to be shipped; and means mounting the second end of each of said spacer strips on said rod for movement toward and away from the base of the rack.

2. The rack as set forth in claim 1 wherein said means for mounting further includes means for pivotally mounting an end of said rod on the backwall of the rack.

3. The rack as set forth in claim 1 wherein the backwall includes a first pair of vertically aligned back support members and a second pair of vertically aligned back support members, and further including means for maintaining the sheets on the rack, the maintaining means including a first pair of vertically aligned engaging pads alignable with ones of the first pair of back support members and a second pair of vertically aligned engaging pads alignable with ones of the second pair of back support members, and wherein said rigid rod is a first rigid rod and further including:

a second rigid rod;

means for pivotally mounting an end of each of said rods to the backwall of the rack in spaced relation to each other for movement toward and away from the backwall of the rack in a plane generally parallel to the plane of the base and with said first rod vertically alignable with the first pair of back support members and the second rod vertically alignable with the second pair of back support members; and wherein said plurality of spacer strips are each made of a compressible material.

4. The rack as set forth in claim 3 wherein the width of each of said spacer strips is approximately equal to or greater than the width or diameter of the back support members.

5. The rack as set forth in claim 1 wherein the sheets are made of glass.

6. The rack as set forth in claim 1 wherein the sheets are automotive windshields.

7. The rack as set forth in claim 1 wherein the separators are made of a compressible material.

8. In a rack for shipping sheets wherein the rack is of the type having a backwall secured to a base and a pair of spaced runners mounted on the base for shipping the sheets on edge in a generally vertical position, the improvement comprising:

a rod having its opposed ends engaging a one of the runners;

a plurality of separators for insertion between the sheets to be shipped pivotally mounted on said rod; and said rod securing said separators to the rack.

9. The rack as set forth in claim 8 wherein the backwall includes a first pair of vertically aligned back supports and a second pair of vertically aligned back supports and said rod includes:

a generally C-shaped member mounted on each of the runners; and wherein said plurality of separators are each made of a compressible material having a dog leg end mounted to a one of said rods, said separators in the vertical position alignable with respective ones of the pair of back support members.

10. The rack as set forth in claim 8 wherein the sheets are glass sheets.

11. The rack as set forth in claim 10 wherein the glass sheets are automotive windshields.

12. The rack as set forth in claim 8 wherein said rod is a first rod and further including:

a second rod having its opposed ends engaging the other one of the runners;

a plurality of separators for insertion between the sheets to be shipped pivotally mounted on said second rod; and said second rod securing said separators thereon to the rack.

13. In a rack for shipping sheets wherein the rack is of the type having a backwall secured to a base and a pair of spaced runners mounted on the base for shipping the sheets on edge in a generally vertical position, the improvement comprising:

an elongated member;

means for mounting said member to the base spaced from and generally parallel to a one of the runners;

a plurality of elongated discrete spacer strips, each having a first end and a second end, the first end pivotally mounted on said elongated member for moving the second end of said spacer strips toward and away from the base, said second ends extending a substantially distance from the elongated member such that adjacent sheets to be shipped are maintained in spaced relationship to one another by said strips; and means for maintaining said spacer strips in a position generally normal to the base.

14. The rack as set forth in claim 13 wherein said elongated member is a first rod and further including:

a second rod;

means for mounting said second rod to the base spaced from and generally parallel to the other one of the runners;

a plurality of spacer strips having a first end and a second end, the first end pivotally mounted on said second rod for moving the second end of said spacer strips on said second rod toward and away from the base; and means for maintaining said spacer strips on said second rod in a position generally normal to the base.

15. The rack as set forth in claim 13 wherein said maintaining means include said spacer strips having a dog leg shape for engaging adjacent runner when said spacer strips are generally normal to the base.

16. The rack as set forth in claim 13 wherein said sheets are glass sheets.

* * * * *